United States Patent [19]

Smith

[11] 4,221,039

[45] Sep. 9, 1980

[54] GASKET HOLDER CLIP

[76] Inventor: Harman S. Smith, 5407 College Ave., St. Louis, Mo. 63136

[21] Appl. No.: 903,954

[22] Filed: May 8, 1978

Related U.S. Application Data

[63] Continuation of Ser. No. 785,598, Apr. 17, 1977, abandoned.

[51] Int. Cl.[2] ..... B25B 27/14

[52] U.S. Cl. ..... 29/271; 29/451; 29/453; 24/261 R; 277/1; 277/10; 285/379

[58] Field of Search ..... 29/271, 453, 526 R; 285/379; 24/73 C, 261 R; 277/10, 1

[56] References Cited

U.S. PATENT DOCUMENTS

| | | | |
|---|---|---|---|
| 917,388 | 4/1909 | Welch | 285/379 X |
| 1,435,887 | 11/1922 | Anderson | 29/271 |
| 2,093,326 | 9/1937 | Legat | 24/261 R X |
| 2,385,202 | 9/1945 | Haas, Jr. et al. | 24/261 R X |
| 2,568,390 | 9/1951 | Gehrke | 29/271 |
| 2,598,169 | 5/1952 | Hubbell | 29/453 X |
| 2,659,950 | 11/1953 | West | 29/453 X |
| 3,261,086 | 7/1966 | Dunn | 29/468 X |

FOREIGN PATENT DOCUMENTS

| | | | |
|---|---|---|---|
| 933215 | 4/1948 | France | 24/73 C |

*Primary Examiner*—Charlie T. Moon
*Attorney, Agent, or Firm*—Glenn K. Robbins

[57] ABSTRACT

A gasket holder clip and method for using the clip to attach a gasket through holes in an underlying flange or the like to maintain alignment of the gasket holes and flange holes. The gasket holder clip is constructed of spring steel wire or other material of high degree of elasticity and rigidity and has a substantially V-shaped configuration with legs of the V-shaped structure having short outwardly turned arms. The clip is employed to hold a gasket having a plurality of holes against an underlying flange, as in an oil pan flange, having holes for registry with the gasket holes by inserting the clip with the legs pressed together through the bottom of the flange hole up and through the gasket hole and then releasing the pressure against the legs of the clip and drawing it down to engage the arms against the top surface of the gasket. The clip maintains the gasket against the flange by the bearing and biasing action of the legs of the clip against the interior walls of the flange hole. The flange with the gasket attached where used with an oil pan or the like is then applied against the motor or other body in which the flanges are to be connected it being understood that only a portion of the holes are provided with the gasket holder clips. The remaining gasket and flange holes are held in proper registry and bolts are passed therethrough to loosely secure the flange to the body to which it is to be connected. After such securement with several bolts the spring-like gasket holder clips are pressed together and removed and the remaining bolts are then passed through the flange and gasket and connected to the motor body or the like and tightened down.

1 Claim, 10 Drawing Figures

GASKET HOLDER CLIP

This is a continuation of application Ser. No. 785,598 filed Apr. 17, 1977, now abandoned.

SUMMARY OF THE INVENTION

In the past it is long been a problem for mechanics or other workmen to secure gaskets having a plurality of holes in proper registry with a flange such as an oil pan flange or the like when the pan is to be connected to the motor block. This problem also occurs in connection with various other types of gaskets provided with holes in which they are to be aligned with flanges of other parts used in various automotive repair. Thus such gaskets are commonly employed with cylinder heads, timing chain covers, valve covers, water pumps and the like.

To prevent misalignment of the gasket holes with the underlying flange in such repair work mechanics have used from time to time strings passing through the holes to tie them together, or various types of glues or cements. Likewise tubular ferrules have been employed with flanges which do not lend themselves to reuse. Such various expedients have been time consuming and expensive. With the advent of more sophisticated motors that are in a large part quite inaccessible and the high expense involved in automotive and other mechanical repair it has been a problem for the average car owner or householder to make such repair and the problem of misaligned gaskets has been a nuisance in the art both to the skilled mechanic and the "do-it-yourselfer".

By means of the instant invention there has been provided a simply constructed gasket holder clip which can be used by a mechanic or the average member of the public who desires to make his own automotive repairs or other types of mechanical repairs involving removal of parts working upon them and reinstallation. A gasket holder clip is simply constructed of spring-like material of construction which may be spring steel wire preferably or plastic or the like, as will be well understood in the art. The gasket holder clip is of a generally V-shaped configuration and is comprised of two legs connected together by a bight portion at one end and having free ends with short out-turned arms that are substantially 90° to the central axis of the clip. The clip although of generally V-shaped construction may have variation depending upon the thickness of the gasket and the depth of the hole and the flange on the body or other structure which is employed with the gasket.

The gasket holder clip may be advantageously employed in connection gasket to the flange of an oil pan when removed from an engine block. Likewise it may be employed with head gaskets for cylinder heads, timing chain covers, valve covers, water pump and the like and generally in any field where gaskets having a plurality of holes are to be secured to an underlying body having aligned holes used in automotive engines or other mechanical application.

The gasket holder clip is very simply employed to align the holes in the gasket with for purpose of example the flange holes in an oil pan to provide for registry of the gasket holes and the holes of the pan flange. Alignment of the gasket with an oil pan flange will be described for purpose of example. The gasket is first aligned so that the holes are in registry with the holes in the flange of the oil pan. A gasket holder clip is then depressed so that the free ends may be passed upwardly through the holes in the flange and the gasket at which point the pressure on the legs of the clip is released and the clip is drawn downwardly such that the short arms of the clip engage the top surface of the gasket while the legs of the clip bear against the inner walls of the holes of the flange. Thus by spring action and friction the clip holds The gasket against the oil pan flange. When two or more of the holes are provided with the clip to hold the gasket against the pan the entire gasket and pan assembly can then be placed against the engine block and at least two bolts can be passed through holes not provided with the clips to loosely secure the pan and gasket against the bottom of the engine block. After such engagement the clips may be pressed together and then withdrawn through the holes to complete the connection of the oil pan to the block with all the bolts being tightened in the conventional manner.

The clips are very simply constructed and the method of the use is one that can be employed by not only skilled auto mechanics but by the average car owner who desires to do his own repair or other mechanical installation besides automotive repair. The clips are inexpensive and can be made in various sizes for different applications as will be readily understood in the art. The use of the gasket holder represents further a saving in labor and time and eliminates the scraping of gasket cement where gasket cement is employed and a new gasket is to replace an old gasket.

The above features are objects of this invention and firther objects will appear in the detailed description which follows and will be otherwise apparent to those skilled in the art.

For the purpose of illustration there is shown in the accompanying drawings a preferred embodiment and modifications of the invention. It is to be understood such drawings are for the purpose of illustration only and that the invention is not limited thereto.

IN THE DRAWINGS

DESCRIPTION OF THE INVENTION

Figure 1:
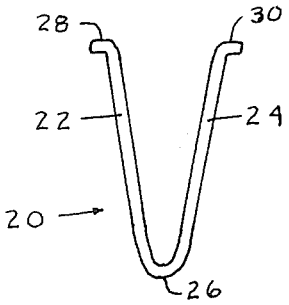
FIG. 1, is a view in front elevation of the preferred embodiment of the clip.
Figure 2:
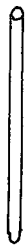
FIG. 2, is a view in side elevation of the clip.

The gasket holder clip of this invention is generally identified by the reference numeral 20 in FIGS. 1 and 2. As there shown it is comprised of a pair diverging legs 22 and 24 connected together at a bight portion 26 to provide a generally V-shaped structure. At the upper free ends of legs 22 and 24 are outwardly turned arms 28 and 30 which generally entend at a 90° angle from the axis of the clip. The gasket holder clip for use in securing the gasket to an oil pan can desirably be, as an example, and inch and a half in length and constructed of 12 of 14 gauge spring steel wire. It will be understood that this dimension and the gauge of the wire may vary and where suitable spring-like plastic of sufficient rigidity is available this can be employed under appropriate circumstance.

For securing gaskets to water pump flanges it is desirable to use a length of about three inches and about 16 gauge material. A similar size can be employed for timing chain covers. For connecting head gaskets to cylinder heads a size of about 6 inches can be employed utilizing 18 gauge wire. It will be apparent to those skilled in the art that the sizes and gauges of the wire may be varied depending upon the application and the size in diameter and thickness of the flange and the thickness of the gasket employed.

For use with gaskets of substantial thickness and hardness and for other applications, variations of the V-shaped configuration may be employed. Thus the modification shown in FIG. 7 may be utilized where the clip is generally identified by the reference numeral 32. This modification may be employed for applications such as connecting gaskets to oil pan flanges and the like. This clip employes a pair of legs having lower V-shaped portions 34 and 36 connected by a bight portion 38. The legs have substantially parallel upper portions 40 and 42 connected to out-turned arms 44 and 46. Shoulders 48 and 50 connect the respective leg portions.

Figure 9:
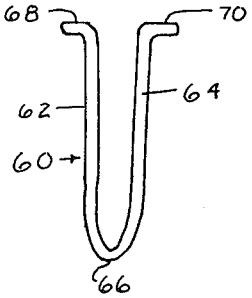
FIG. 9, is a view in front elevation of a further modification of the gasket holder clip.

A further modification is shown in FIG. 9 and identified by the reference numeral 60. This clip employs a pair of slightly inwardly bowed legs 62 and 64 connected be bight portion 66 with the legs being substantially parallel in a U-shaped configuration. Out-turned arms at the free ends of the legs are provided by arms 68 and 70.

METHOD OF USE

The gasket holder clip 20 of this invention is very simply employed in its method of use. The use will be described in connection with the clipping of the gasket to the flange of an oil pan to maintain alignment of the gasket holes with the flange holes of the oil pan. It will be understood however, that method of use is carried out in a similar fashion to maintain alignment of gasket holes against the surface of the body with which the gasket is employed in other applications whether it be for oil pan, water pump, valve cover, timing chain cover, a cylinder head for automobiles or for other mechanical applications as will be readily understood in the art.

Figure 3:
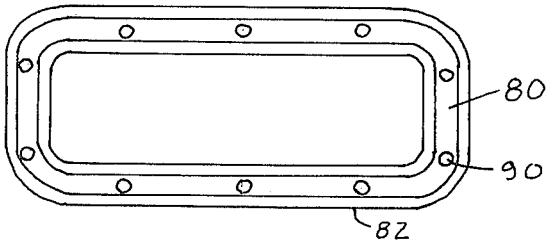
FIG. 3, is a top plan view showing the alignment of a gasket with an underlying oil pan.
Figure 4:
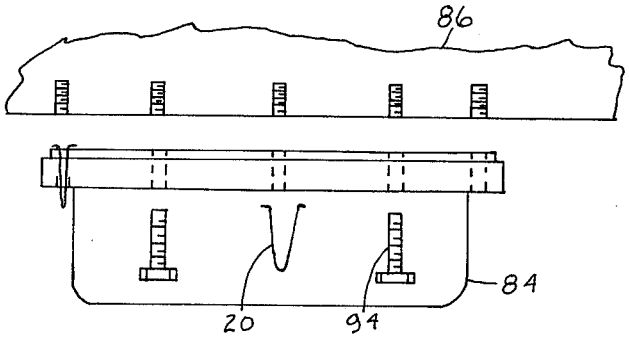
FIG. 4, is a fragmentary view in elevation and partly in section showing the use of the clips in holding the gasket and connection of the oil pan to an engine block.
Figure 10:
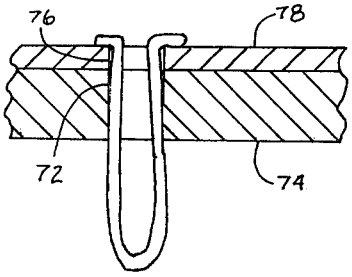
FIG. 10, is a view in vertical cross section through a gasket and flange showing the use of the clip of FIG. 8.

The method of application is best shown in FIGS. 3 through 6. The clip is employed with an oil pan gasket 80 which as shown in FIG. 3 is placed upon a flange 82 of an oil pan 84. The oil pan is one that is conventionally employed with an engine block 86 having tap holes 88 as shown in FIG. 4.

Figure 5:
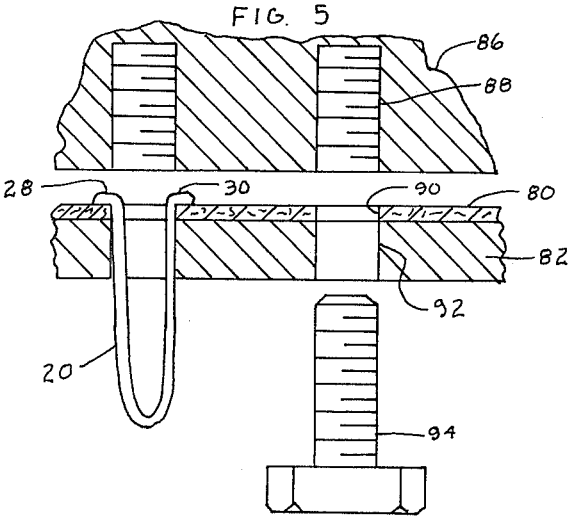
FIG. 5, is an enlarged view in section through a portion of the engine block and an underlying gasket and oil pan flange and use of the gasket holder clip.

In the preliminary operation the gasket 80 with the gasket holes 90 is placed in alignment over the flange 82 of the oil pan and the flange holes 92. After this alignment has been effected the clip 20 is depressed so that the arms 28 and 30 are moved towards one another to fit through the bottom of the flange hole as shown in FIGS. 4 and 5. The clip will then fit through the hole and is moved upwardly so that the arms overlay the sides of the holes of the gasket.

In this fashion at least two clips are inserted through the holes in the flange and the gasket to clip the gasket against the flange to maintain the gasket holes in alignment amd proper registry with the flange holes. The gasket is now securely clipped to the flange of the oil pan and if desired in the operation the oil pan can even be turned upside down and moved in any fashion and the clip will maintain the gasket against the flange.

Figure 6:
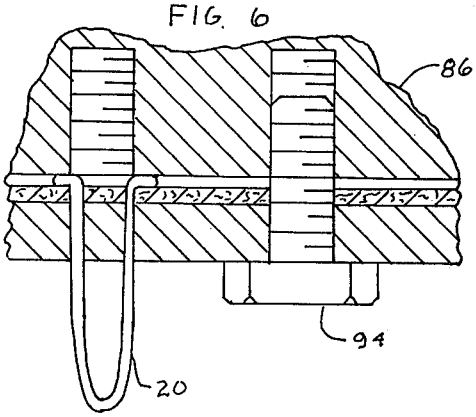
FIG. 6, is a view similar to FIG. 5, but showing the preliminary connection of the oil pan with the gasket to the engine block.

The oil pan with the gasket secured is then moved into proper registry with the tapped holes 88 in the crankcase of the engine block as shown in FIG. 3 and a bolt 94 is inserted through one of the free holes until it engages the tap hole in the engine block as shown in FIG. 6. At least two bolts are so connected to hold the oil pan against the engine block at which point the gasket holder clips can be pressed together and then removed for later use in other gasket holding applications as desired. The remaining bolts are then passed through the holes in oil pan flanges for connection to the engine block and the bolts are tightened to complete the operation.

Figure 7:
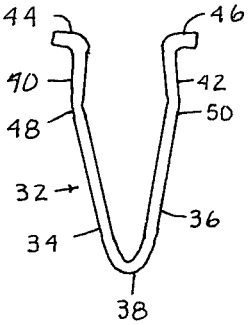
FIG. 7, is a view in front elevation of a modified gasket holder clip.
Figure 8:
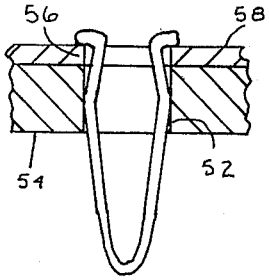
FIG. 8, is a view in vertical cross section through a gasket and flange showing the use of the clip of FIG. 7.

The modifications in FIGS. 7 and 9 may be employed in a similar fashion to the clip 20 of FIGS. 1 and 2. Where the gasket is of substantial degree of hardness or thickness to hinder the bearing of the legs against the inner wall surface of the holes of the flange or other body in which the gasket is employed these modifications may be employed. Thus for the clip 32 as shown in FIG. 8 the junction of the V-shaped leg sections 34 and 36 with the parallel sections 40 and 42 forming the shoulders 48 and 50 will bear against the inner wall surface of the holes 52 in flange 54 when the clip is slightly pressed together in the positioning inside the flange hole. The upper portions 40 and 42 will diverge slightly away from the gasket inner wall forming the hole 56 while the out-turned arms 44 and 46 will still bear against the top surface of the gasket 58.

The modifications of the gasket holder clip in the substantially U-shaped clip 60 of FIG. 9 may be employed where the flange holes are of substantial thickness and other types of relatively simple applications as desired. The inward bowing of the legs aids in the bearing or drag against the walls of the hole 72 in the flange 74. The upper portions of the legs 62 and 64 may bear slightly inwardly of the hole 76 in the gasket 78 but the clip arms will bear against the top surface of the gasket and hold it in place.

Various other changes and modifications may be made within this invention as will be readily understood by those skilled in the art. Such changes and modifications are within the scope and teaching of this invention as defined by the claims appended hereto.

I claim:

1. The combination of a gasket of varying thickness provided with holes, an underlying member having corresponding holes and a gasket holder clip for holding said gasket in alignment with said member, said clip comprising a bifurcated clip formed by a pair of legs connected together at one end by a bight portion no wider than the diameter of the holes of said underlying member, said legs being comprised of a first leg portion extending outwardly from the bight portion to a bent portion and a second leg portion extending from the bent portion, said second leg portion being connected to out-turned arms, said arms extending laterally a short distance such that when the legs are pressed together the arms can pass through said holes, said legs being biased together at the bight portion such that when they are passed together they tend to return to their original position and bear at the bent portion against the inner surface of the hole in said member, said second portions of said legs being bowed slightly inwardly of both said first leg portions and the holes in said underlying member when compressed and fitted in said bearing engagement within the holes in said member whereby the second portions of the legs adjacent the arms are spaced from the wall surfaces of the holes in said member and gasket and said arms overlie said gasket in restraining relation.

* * * * *